US006772814B2

(12) United States Patent
Leist et al.

(10) Patent No.: US 6,772,814 B2
(45) Date of Patent: Aug. 10, 2004

(54) COMBINED WEATHER SEAL, LIGHT BLOCK AND WEAR INSERT FOR OVERHEAD DOOR PANEL

(75) Inventors: Alan R. Leist, Cincinnati, OH (US); Richard J. Lewis, Jr., Loveland, OH (US); Jeffrey W. Stone, Lebanon, OH (US); Thomas E. Youtsey, Southgate, KY (US)

(73) Assignee: Clopay Building Products R&D Company, Inc., Cincinnati, OH (US)

( * ) Notice: Subject to any disclaimer, the term of this patent is extended or adjusted under 35 U.S.C. 154(b) by 0 days.

(21) Appl. No.: 10/194,000

(22) Filed: Jul. 12, 2002

(65) Prior Publication Data

US 2002/0179256 A1 Dec. 5, 2002

Related U.S. Application Data

(63) Continuation-in-part of application No. 10/078,031, filed on Feb. 19, 2002, now abandoned, which is a continuation-in-part of application No. 09/689,569, filed on Oct. 12, 2000, now abandoned, which is a continuation-in-part of application No. 09/473,338, filed on Dec. 28, 1999, now abandoned, which is a continuation-in-part of application No. 09/005,628, filed on Jan. 9, 1998, now Pat. No. 6,006,817.

(51) Int. Cl.[7] ..... E06B 7/16
(52) U.S. Cl. ..... 160/40; 160/201; 160/229.1
(58) Field of Search ..... 160/40, 229.1, 160/235, 201; 49/91.1, 489.1

(56) References Cited

U.S. PATENT DOCUMENTS

| | | | |
|---|---|---|---|
| 269,986 | A | 1/1883 | Alexander |
| 1,030,801 | A | 6/1912 | Berault |
| 1,174,539 | A | 3/1916 | Bauer |
| 1,562,565 | A | 11/1925 | Koze |
| 1,635,941 | A | 7/1927 | Kendall |

(List continued on next page.)

FOREIGN PATENT DOCUMENTS

| | | |
|---|---|---|
| DE | 1659464 | 10/1969 |
| DE | 2918638 | 11/1979 |
| DE | 3113656 | 10/1982 |

(List continued on next page.)

OTHER PUBLICATIONS

Amarr, *Amarr Product Bulletin No. 11–02*, Dec. 30, 2002.
Clopay, *We Look Right At Home, and additional drawings of products disclosed therein*, Brochure, circa 1995.
International Search Report, PCT/US98/2775, Jul. 5, 1999.
International Search Report, PCT/US00/35153, Mar. 28, 2001.

*Primary Examiner*—Blair M. Johnson
(74) *Attorney, Agent, or Firm*—Wood, Herron & Evans, L.L.P.

(57) ABSTRACT

An overhead door and associated mating panels include enhanced wear surfaces and protection against the intrusion of climatic elements or the like in the form of a combined weather seal, light block and wear insert on the upper and/or lower edges of the mating adjacent door panels. The wear surfaces are utilized during the opening and closing of the door so that frictional interaction or rubbing between the mating edges is minimized to reduce wear and damage to the panels over the service life of the door. Additionally, the wear insert portion reduces a gap between the mating edges of the adjacent panels to provide enhanced protection without requiring increased roll forming tolerances on the panel manufacturing process. Moreover, the invention includes upright projecting weather seal and light blocking portions that are positioned in a gap formed at the juncture of the mating panels. When the door is closed, the weather seal and light blocking portions are deflected. The weather seal provides a climatic barrier as well as inhibiting the passage of foreign material between the mated panels and the light block inhibits light from passing between the mated panels.

36 Claims, 4 Drawing Sheets

U.S. PATENT DOCUMENTS 1,697,772 A 1/1929 Lewis
1,827,433 A 10/1931 Kendall
1,888,162 A 11/1932 Eklund
2,196,903 A 4/1940 Rowe et al.
2,233,351 A 2/1941 Rowe
2,257,513 A 9/1941 Pilcher
2,372,792 A 4/1945 Oswald
2,391,845 A 12/1945 Rowe
2,484,609 A 10/1949 Clark
2,494,001 A 1/1950 Rowe
2,557,716 A 6/1951 Allee
2,557,753 A 6/1951 Mitchell
2,637,381 A 5/1953 Bowman
2,688,365 A 9/1954 Garubo
2,871,932 A 2/1959 Stroup
2,952,313 A 9/1960 Stroup
3,000,048 A 9/1961 Harsch
3,008,175 A 11/1961 Biedinger et al.
3,090,427 A 5/1963 Stroup et al.
3,104,699 A 9/1963 Wolf et al.
3,109,483 A 11/1963 Merrill
3,176,757 A 4/1965 Lomaz
3,198,242 A * 8/1965 Crosswell ..... 160/190
3,253,552 A 5/1966 Stein
3,334,681 A 8/1967 Crosswell
3,347,305 A 10/1967 Urbanick
3,376,913 A 4/1968 Clapsaddle
3,378,958 A * 4/1968 Parks et al. ..... 49/489.1
3,402,457 A 9/1968 Landow et al.
3,457,983 A 7/1969 Pemberton et al.
3,594,073 A 7/1971 Liautaud
3,648,755 A 3/1972 Thiele
3,672,424 A 6/1972 Brown
3,740,916 A 6/1973 Kenaga
3,772,129 A 11/1973 Dover
3,798,839 A 3/1974 Kaufman
3,852,943 A 12/1974 Healy
3,891,021 A 6/1975 Geoffrey
3,934,635 A 1/1976 Kin
3,941,180 A 3/1976 Thill
3,980,123 A 9/1976 Vago
4,008,745 A 2/1977 Bailey
4,073,037 A 2/1978 Curry et al.
4,205,713 A 6/1980 Galbreath
4,485,544 A 12/1984 Van Ryswyk
4,510,663 A 4/1985 Friesz
4,589,240 A 5/1986 Kendall et al.
4,718,472 A 1/1988 Hormann
4,787,121 A 11/1988 Racenis et al.
4,793,397 A 12/1988 Whiteman
4,794,972 A 1/1989 Hormann
4,846,247 A 7/1989 Kessler
4,854,365 A 8/1989 Juneau
4,893,666 A 1/1990 Hormann
4,979,553 A * 12/1990 Lowry et al. ..... 160/133
4,989,660 A 2/1991 Wagner
4,991,639 A 2/1991 Clay, Jr. et al.
4,995,441 A * 2/1991 Leist et al. ..... 160/229.1
5,002,114 A 3/1991 Hormann
5,016,700 A * 5/1991 Wegner et al. ..... 160/232
5,040,268 A 8/1991 Knurr
5,129,441 A 7/1992 Leist et al.
5,148,850 A 9/1992 Urbanick
5,170,832 A 12/1992 Wagner
5,188,163 A 2/1993 Schwartzengraber et al.
5,235,724 A 8/1993 Perrin et al.
5,365,990 A 11/1994 Ueda
5,398,379 A 3/1995 Kiefer
5,435,108 A 7/1995 Overholt et al.
5,445,207 A 8/1995 Romanelli et al.
5,448,799 A 9/1995 Stein et al.
5,495,640 A 3/1996 Mullet et al.
5,509,457 A 4/1996 Jella
5,522,446 A 6/1996 Mullet et al.
5,551,125 A 9/1996 Adams
5,555,923 A 9/1996 Leist et al.
5,562,141 A 10/1996 Mullet et al.
5,566,740 A 10/1996 Mullet et al.
5,588,475 A 12/1996 Martin
5,630,459 A 5/1997 Martin
5,782,283 A 7/1998 Kendall
5,921,307 A 7/1999 Ford et al.
5,927,369 A 7/1999 Pedersen
6,006,817 A 12/1999 Stone et al.
6,076,590 A * 6/2000 Ford et al. ..... 160/229.1
6,098,696 A * 8/2000 Styra ..... 160/201
6,253,825 B1 7/2001 Petersson et al.
6,330,901 B1 * 12/2001 Friesen et al. ..... 160/201

FOREIGN PATENT DOCUMENTS

DE 3828703 2/1990
DE 4019569 1/1992
DE 4227311 2/1994
DE 9406615 9/1994
EP 0231833 8/1987
EP 0370376 5/1990
EP 0394691 10/1990
EP 418629 3/1991
EP 0825320 2/1998
FR 920097 3/1947
GB 124686 4/1919
GB 494255 10/1938
IT 464792 7/1951
WO WO90/14486 11/1990
WO WO95/31627 11/1995
WO WO97/02401 7/1996
WO WO97/10405 3/1997
WO WO99/35363 7/1999

* cited by examiner

COMBINED WEATHER SEAL, LIGHT BLOCK AND WEAR INSERT FOR OVERHEAD DOOR PANEL

This is a continuation-in-part of U.S. patent application Ser. No. 10/078,031 filed Feb. 19, 2002 now abandoned which was a continuation-in-part of U.S. patent application Ser. No. 09/689,569 filed Oct. 12, 2000 now abandoned, which was a continuation-in-part of U.S. patent application Ser. No. 09/473,338, filed Dec. 28, 1999 now abandoned, which was a continuation-in-part of U.S. patent application Ser. No. 09/005,628, filed Jan. 9, 1998 and issued as U.S. Pat. No. 6,006,817 on Dec. 28, 1999, all of which are incorporated herein by reference in their entirety.

BACKGROUND OF THE INVENTION

This invention relates to overhead doors and, more particularly, to an overhead door panel that has an improved wear surface on the mating adjacent edges of the panels and provides an improved light block and weather barrier for an overhead door.

There are numerous designs of overhead or retractable door assemblies which are commonly used for garage doors, truck doors, warehouse doors or the like. Typically, an overhead door of this type is convertible between an open, overhead or generally horizontal configuration and a closed generally vertically oriented configuration in which the door closes an opening in the building or the like. The overhead door is typically movable along a track assembly mounted proximate the opening and the track assembly commonly includes a generally vertical track section, a generally horizontal track section and a curved transition track section joining the horizontal and vertical sections together.

Retractable overhead doors of this type are conventionally constructed of a number of vertically arranged, horizontally oriented panels which can fold along the horizontal divisions between the panels to enable the door to pass along the curved transition section of the track when being opened or closed. The panels are pivotally coupled together with hinges on the interior surface or back face of the door panels. Commonly, gaps appear between the adjacent panels while the panels are traveling toward and/or through the curved transition section of the track. Foreign objects could be inserted into these gaps by accident or due to improper handling of the door.

Recently, many different overhead door designs have been suggested which are aimed at addressing this situation. Commonly, such designs are referred to as "pinch-resistant" or the like in the industry. These types of door designs often include complicated hinge structures, guards which cover the gaps between the articulating panels or involved and complicated panel geometries to minimize or inhibit the insertion of a probe or other foreign object between the adjacent articulating panels. One such design is disclosed in U.S. Pat. No. 6,006,817, assigned to the assignee of this invention.

The panel configuration, geometry and interaction between the adjacent panels is often very important to providing the desired benefits of such a design. The tolerances, the interrelationship of the assembled panels and the installation of the door is therefore very important to its proper operation. The ability to minimize the spacing or gap between the adjacent panels is very advantageous to providing pinch-resistant protection. Standard objectives for such designs focus on a maximum spacing or gap of 4 to 9 millimeters or even less.

Proper alignment of the panels relative to one another is very important to achieve proper operation of the door. Furthermore, improper alignment of the panels may resulting in binding or interference of the adjacent panels during articulation of the door between the opened and closed configurations. Further, improper alignment or installation of the panels often results in excessive rubbing or interaction between the adjacent panels which results in the increased wear, rubbing, friction or the like along the mating edges of the adjacent panels. Commonly, the panels are constructed of aluminum, steel or other metal materials and have a wood grain or other textured surface embossed, formed or imprinted thereon to provide the appearance of a wood panel. This textured surface often includes a number of closely spaced bumps, ridges or the like to simulate the wood grain appearance. Such bumps and ridges are easily scraped, rubbed or damaged when the panels interact with one another.

Additionally, many such panel designs do not provide for adequate protection to inhibit moisture, light, dirt, wind or other foreign elements from entering into and passing through the door between the adjacent panels, particularly when the door is exposed to extreme weather.

Therefore, there is a need in the industry for an improved wear surface on the mating edges of garage door panels, particularly for the above-described panels, which does not wear, degrade or rub to result in damage to the panels and which provides for the desired tolerances and spacing between the mating edges of the panels to meet design objectives while also offering a barrier to the weather, light and debris for the mating edges.

SUMMARY OF THE INVENTION

A presently preferred embodiment of this invention offers these and other advantages over known overhead door and panel designs. The overhead door according to this invention in one embodiment includes a number of horizontally oriented panels vertically stacked one upon the other in edge-to-edge relationship. The panel design of the door includes an outer, preferably metal, skin which extends from a front face of the door panel around upper and lower edges of the panel. The upper edge of the panel includes a short landing area or shoulder which projects perpendicularly from the front face of the panel. The upper edge of each panel includes a generally convex, segmented or polygonal surface which is configured to mate with the lower edge of an adjacent panel. The lower edge includes a rounded nose portion and a segmented or polygonal concave surface.

The panels are coupled to a track assembly mounted proximate the garage, warehouse, truck or other opening. The track assembly includes a generally vertical section, a generally horizontal section and a curved transition section joining the horizontal and vertical sections together. Rollers are mounted on the panels and coupled to the track assembly to guide the door between a closed generally vertical configuration with the upper and lower edges of the adjacent panels mated together and an open generally horizontal configuration extending generally parallel to the ceiling of the garage or the like.

The mating upper and lower edges of the adjacent panels contact each other at specified contact locations when the door is in the closed configuration. In one presently preferred embodiment, the upper and lower edges have first and second spaced contact locations in which the first contact location is formed between the nose on the lower edge of upper panel and the shoulder on the upper edge of the lower panel. The second contact location in one presently preferred embodiment of this invention is spaced from the first contact location and is proximate the back face of the panels. The skin preferably has an embossed wood grain texture or appearance.

Advantageously, frictional interaction, rubbing, wear or damage to the panel edges is minimized, particularly at the contact locations, by a combined weather seal, light block and wear insert which in one embodiment includes an anchor portion in the form of a pair of legs or the like which are inserted into a groove formed in the central region of the upper edge of each panel. The wear insert portion is preferably polypropylene and covers at least a section of the upper edge of each panel. The combined weather seal, light block and wear insert is located in the gap between the contact locations of the adjacent panels and between the mating edges of the panels at the rear contact location proximate the back face of the panels. The wear insert portion is preferably in one of two embodiments: (1) "long" in which it extends between the panel edges at the front contact location near the front face of the panels and the back contact location near the back faces, or (2) "short" in which it does not extend to the front contact location and ends in the central region of the panel's cross-section. Advantageously, the wear insert minimizes the rubbing or friction between the adjacent panels during articulation of the panels.

The wear insert portion may in some embodiments minimize the gap between the mating edges of the adjacent panels to offer increased protection without increased roll forming tolerances for the panel edges. As such, the wear insert portion is primarily utilized during the opening and closing of the door so that frictional interaction or rubbing between the mating edges of the panels is minimized. In other words, the mating edges of the adjacent panels which would normally rub or interact during the opening and/or closing of the door will contact the wear insert thereby alleviating friction, wear and potential damage to the edges of the panels. However, when the door is ultimately in the closed configuration, the insert does not detrimentally interfere with the adjacent panels thereby allowing the panels to properly mate, align and support one another according to the desired specifications and requirements. The wear insert further provides a reduced spacing between the mating edges and increased protection without tightening the roll forming tolerances and requirements on the panels.

The weather seal portion in one embodiment of this invention is a flexible fin and projects generally upright or perpendicularly from the wear insert portion just behind the anchor portion and in front of the rear contact location. The weather seal fin deflects or bends when the panels are mated together and inhibits water, wind and the like from passing between the adjacent panels.

Additionally, this invention in one embodiment includes a light blocking flexible fin that projects generally upright or perpendicularly from the wear insert portion proximate a trailing edge of the wear insert. The light blocking fin closes the gap between the mating edges of the adjacent panels and in one embodiment deflects or bends to block the passage of light between the adjacent panels.

Therefore, with this invention the regions of the mating edges of adjacent panels in an overhead door which normally would experience friction, rubbing, wear and potential damage are protected and the joints between the panels are weather and light resistant due to the combined weather seal, light block and wear insert embodied in this invention. As a result, the required mating configuration, interrelation and compatibility of the adjacent panels to achieve the design parameters are maintained without excessive wear, friction, rubbing or damage to the panels during opening and closing of the door or increased roll forming demands on the production of the panels while still providing a weather and light barrier when the door is closed.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
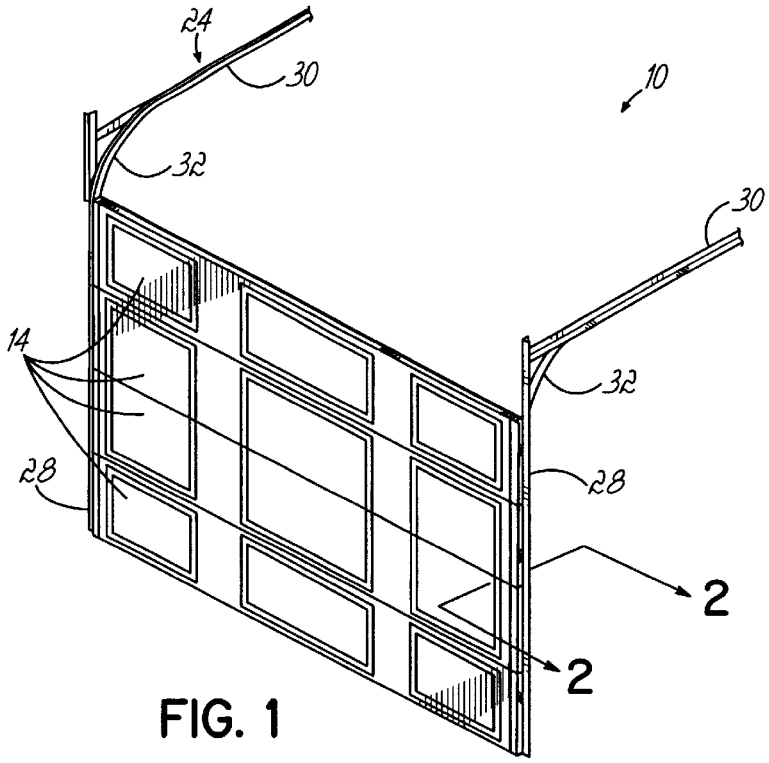
FIG. 1 is a perspective view of an overhead door covering an opening according to a presently preferred embodiment of this invention.

Referring to FIG. 1, a presently preferred embodiment of an overhead door 10 according to this invention is shown in a closed generally vertical configuration covering an opening in a wall (not shown) of a garage, warehouse or the like. The door 10 includes a plurality, four of which are shown in FIG. 1, of panels 14. Each panel 14 includes upper and lower generally horizontally oriented edges 16, 18 which are configured to mate with the lower and upper edges 18, 16 respectively, of an adjacent panel 14 when the door 10 is in the closed configuration as shown in FIG. 1.

Figure 2:
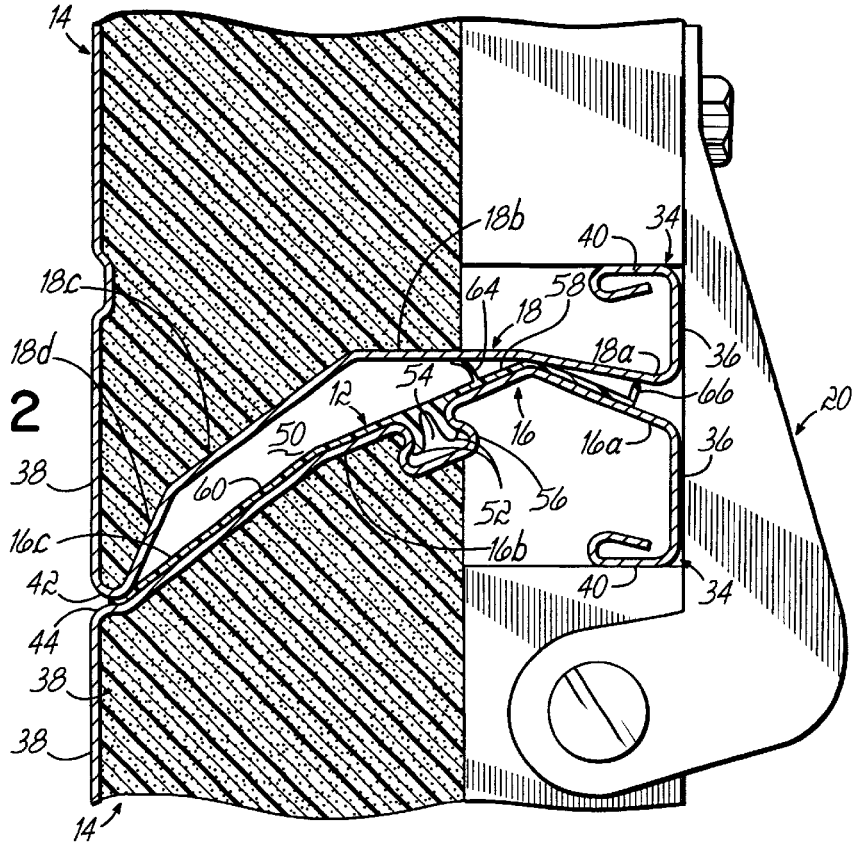
FIGS. 2 and 3 are each cross-sectional views of alternative embodiments of a combined weather seal, light block and wear insert installed between mating panels of the door of FIG. 1.
Figure 3:
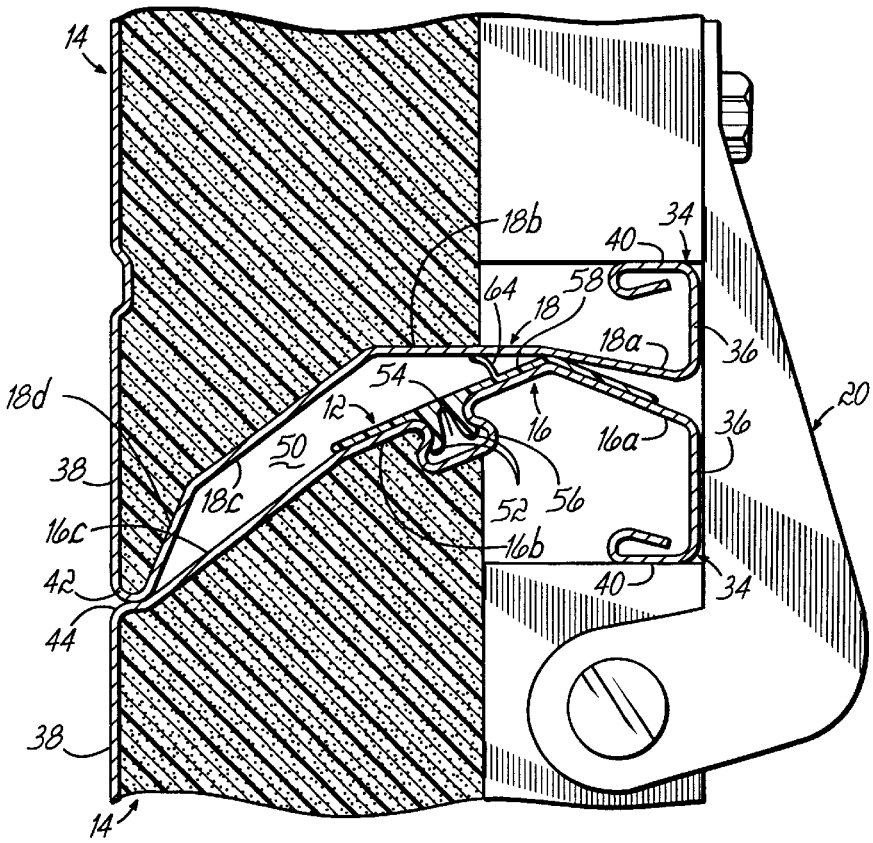
Figure 4:
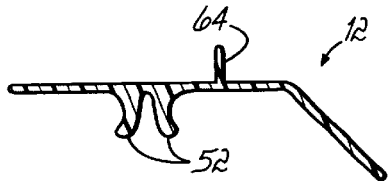
FIG. 4 is a side elevational view of the combined weather seal, light block and wear insert of FIG. 3.
Figure 5:
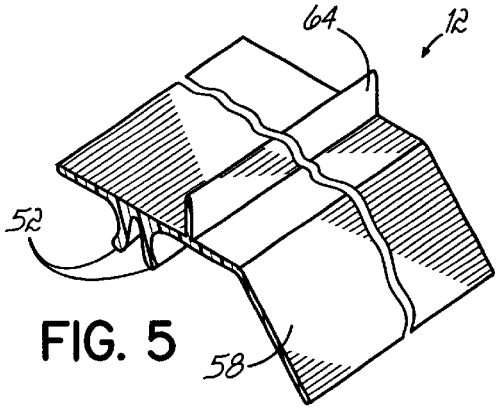
FIGS. 5 and 6 are top and bottom perspective views, respectively, of the combined weather seal, light block and wear insert of FIG. 4.
Figure 6:
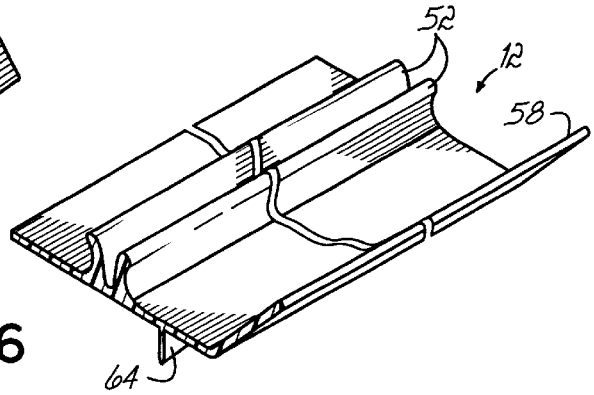
Figure 7:
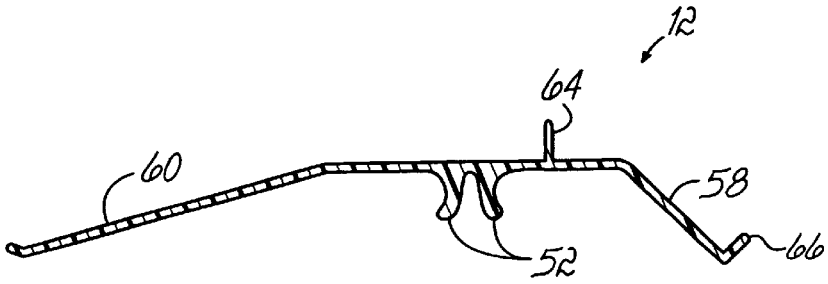
FIG. 7 is a side elevational view of the combined weather seal, light block and wear insert of FIG. 2.
Figure 8:
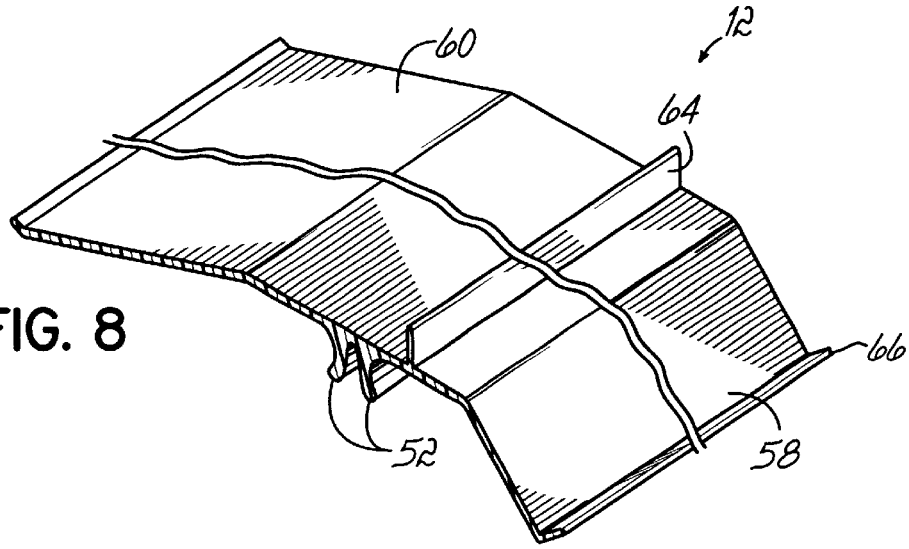
FIGS. 8 and 9 are top and bottom perspective views, respectively, of the combined weather seal, light block and wear insert of FIG. 7.
Figure 9:
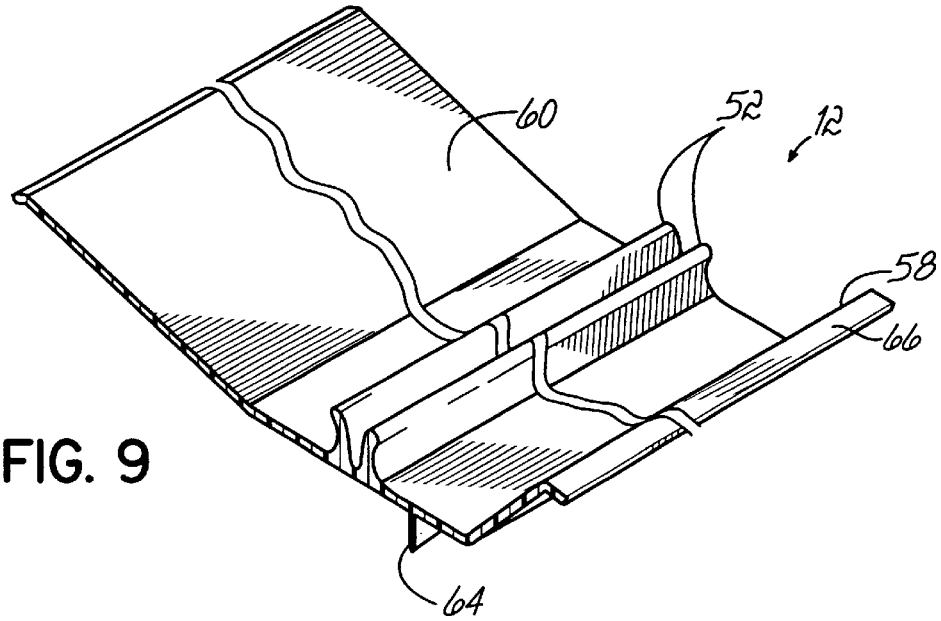

Referring to FIGS. 2 and 3, the adjacent panels 14 are pivotally connected together by a number of hinges 20. The hinges 20 proximate the lateral side ends of each panel 14 include a roller assembly (not shown) for coupling the door 10 to a track assembly 24 (FIG. 1). The roller assemblies are mounted on the panels 14 and coupled to the track assembly 24 to guide the door 10 between the closed and open configurations. The track assembly 24 includes a pair of vertical sections 28, each of which are mounted to the wall on opposite sides of the opening. The vertical sections 28 are each connected to a horizontal section 30 through a curved transition section 32 as is readily know by one skilled in the art. Each track section 28, 30, 32 has a generally J-shaped or C-shaped cross-sectional configuration into which each of the rollers of the roller assemblies is captured to assist in the movement and articulation of the door 10 to and between the closed and open configuration as the rollers translate along the vertical, transition and horizontal sections of the track assembly 24.

Referring to FIGS. 2–3, the upper and lower edges 16, 18 of the panels 14 are each finished with a rail 34 joined to the respective edges 16, 18. The rail 34 includes a back face 36 which is generally parallel to a panel front face 38 and a terminal lip 40 which projects perpendicularly to the back face 36 and toward the front face 38. The lower edge 18 of each panel 14 according to a presently preferred embodiment of this invention has a generally concave configuration for mating with the upper generally convex-shaped edge 16 of an adjacent panel 14. Specifically, the upper and lower edges 16, 18 each have a number of facets 16*a*, 16*b*, 16*c* and 18*a*, 18*b*, 18*c*, 18*d*, respectively, forming the respective shapes.

A rounded nose 42 is at the junction between the front face 38 of the panel 14 and the lower edge 18. At the juncture between the front face 38 and the upper edge 16 of the panel 14 is a shoulder 44 providing a landing area for the nose 42 when the door 10 is in the closed configuration as shown in FIG. 1. In the closed configuration, the nose 42 on the lower edge 18 of the panel 14 normally contacts the shoulder 44 on the upper edge 16 of the adjacent panel 14 at the front faces 38 of the panels 14 thereby providing a first contact location between the mating adjacent panels 14.

A second contact location between the adjacent upper and lower edges 16, 18 of the panels 14 according to one embodiment of this invention is proximate the back face 36 of the panels 14 and includes an obliquely angled or, more specifically, a downwardly sloping interface between the upper and lower edges 16, 18 when the door 10 is in the closed configuration. The upper edge 16 of each panel 14 includes the generally planar facet 16*a* at the juncture between the rail 34 and the upper edge 16; whereas, the lower edge 18 also includes the generally planar facet 18*a* at the juncture between the lower edge 18 and the rail 42 of the panel 14. In the closed configuration, the planar facets 18*a*, 16*a* are normally in contact to form the second contact location.

Due to the configuration of the mating upper and lower edges 16, 18 of the adjacent panels 14 and the first and second contact locations, an uninterrupted gap 50 is provided between the first and second contact locations as shown in FIGS. 2–3. Preferably, the panels 14, including the upper and lower edges 16, 18 and the rails 42, are roll-formed from a single piece of metal, preferably aluminum or steel. Alternatively, the panel 14 may be extruded, injection molded or compression molded from a plastic composition or synthetic material.

Figure 10:
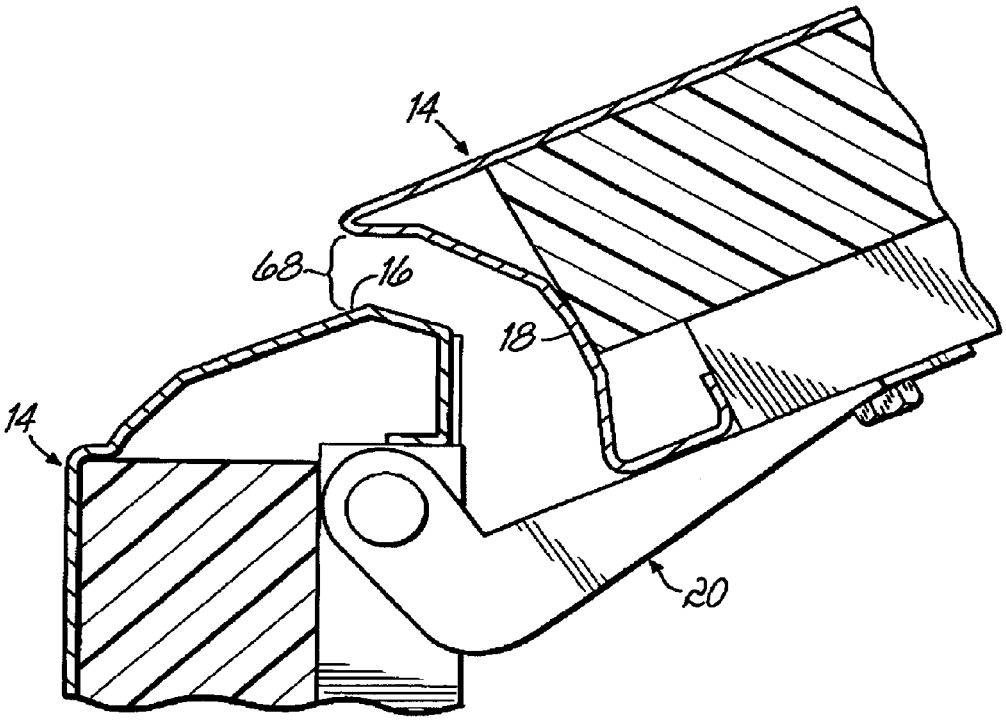
FIG. 10 is a cross-sectional view of mating upper and lower panels in which the upper panel is being pivoted through the hinge relative to the lower panel.

Articulation of the adjacent panels 14 as shown in FIG. 10 results in movement of the lower edge 18 relative to the upper edge 16 of the adjacent panel 14. However, due to the configuration of the upper and lower edges 16, 18 of the panels 14 and the design of the hinge 20, a spacing 68 between the panels 14 is minimized during articulation and the configuration of the spacing is optimized to inhibit the insertion of a foreign object such as a probe or the like (not shown) between the panels 14. The upper and lower edges 16, 18 substantially separate from one another when the panels are pivoting relative to each other. An important feature of the design is the configuration of the non-circular upper and lower edges 16, 18. Specifically, the polygonal, faceted shape of the lower edge 18 relative to the pivot axis of the hinge 20 assists in minimizing the opportunity for insertion of a foreign object and injection such an object once inserted, as described in more detail in applicant's issued U.S. Pat. No. 6,006,817.

As shown in FIGS. 2–3, the panels 14 according to the presently preferred embodiments of this invention include a combined weather seal, light block and wear insert 12 which is positioned on the upper edge 16 of the panels at one or more of the contact locations between the mating adjacent panels 14.

Under some operating conditions of the door 10, the upper and lower edges 16, 18 rub against one another during opening and closing of the door 10. Over the service life of the door 10, wear of the upper and lower edges 16, 18 of the panel 14 is minimized with the combined weather seal, light block and wear insert 12. Furthermore, friction between the edges 16, 18 of the panels 14 is reduced during articulation of the door 10 with the combined weather seal, light block and wear insert 12. As shown in FIGS. 2–3, the combined weather seal, light block and wear insert 12 is preferably located at one or more of the contact locations between the mating edges 16, 18 of the adjacent panels 14. In one embodiment, the combined weather seal, light block and wear insert 12 includes a pair of downwardly projecting legs 52 which are press-fit into and retained in a narrowed throat region 54 of a channel or groove 56 in the upper edge 16, as shown in FIGS. 2–3. The insert 12 extends the entire width of the panels 14. In the embodiments of FIGS. 2–3, the combined weather seal, light block and wear insert 12 includes a trailing tail 58 covering all or portions of facets 16*a*, 16*b* and which is positioned between the upper and lower edges 16, 18 of the panels 14 at the second contact location proximate the back face 36 of the panels 14.

As shown in FIG. 2, the combined weather seal, light block and wear insert 12 in one embodiment covers substantially the entire upper edge 16 of the panel 14. In addition to the trailing tail 58 positioned between the upper and lower edges 16, 18 when the panels 14 are mated, a forward extension 60 is sandwiched between the nose 42 and shoulder 44 proximate the front faces 38 of the panels 14. In the embodiment shown in FIG. 2 of the combined weather seal, light block and wear insert 12, the upper and lower edges 16, 18 of the respective panels are not directly in contact with each other thereby avoiding frictional interaction, rubbing and wear between the panel edges 16, 18 during articulation of the door 10. Preferably, the tail 58 and forward extension 60 portions of the combined weather seal, light block and wear insert 12 substantially conform to the profile of the upper edge 16 of the panel on which they are located.

In an alternative embodiment as shown in FIG. 3, the combined weather seal, light block and wear insert 12 does not include a forward extension 60 as shown in FIG. 2. With the embodiment of FIG. 3, the nose 42 on the lower edge 18 of the superjacent panel 14 contacts the shoulder 44 on the lower edge 18 of the subjacent panel 14 proximate the front faces 38 of the panels 14. The combined weather seal, light block and wear insert 12 of FIG. 3 covers the facet 16*b* of the upper edge 16 proximate the channel or groove 56 as well as most of the facet 16*a* substantially covered by the tail 58. Once again, the combined weather seal, light block and wear insert 12 substantially conforms to the sections of the upper edge 16 of the panel 14 on which it is positioned. In presently preferred embodiments of the invention, the wear portions including the trailing tail 58, forward extension 60 are preferably polypropylene or other appropriate material and have a thickness of approximately 0.025 inches.

The combined weather seal, light block and wear insert 12 additionally minimizes the gap 50 between the mating edges 16, 18 of the panels 14 for enhanced protection without requiring changes to the roll forming or manufacturing tolerances for the panels 14.

During articulation of the overhead door 10, the lower edge 18 of the superjacent panel 14 engages the wear portion of the combined weather seal, light block and wear insert 12 and not the upper edge 18 of the subjacent panel 14, as shown in FIGS. 2–3, thereby avoiding frictional interaction, rubbing and wear between the panel edges 16, 18. Preferably the combined weather seal, light block and wear insert 12 is coated with and/or submerged in a silicone bath which eases its installation into the groove 56 and minimizes frictional interaction with the panel edges 16, 18 during articulation of the door 10.

The combined weather seal, light block and wear insert 12 according to the embodiments shown in FIGS. 2 and 3 each also include a weather seal portion in the form of an upwardly projecting fin 64 which provides the weather seal function to the invention when installed between the mating edges 16, 18 of adjacent panels 14. Preferably, the fin 64 is generally planar and projects generally perpendicularly from the wear insert portion to which it is attached. Alternatively, the fin 64 is bulbous or of another configuration appropriate to satisfy its operational requirements. In the embodiment shown in FIGS. 2 and 3, the fin 64 is flexible and made from a thermoplastic elastomer (TPE) such as Santoprene® (www.santoprene.com) or equivalent material. The fin 64 has a thickness of approximately 0.016 inches and a height of approximately 0.200 inches. The fin 64 extends the entire width of the panel 14 and unlike other weather seal designs does not suffer fatigue damage, cracking and failure. The fin 64 extends generally perpendicularly in a planar orientation when the door 10 is not in a closed configuration; however, when the upper and lower edges 16, 18 of the panels 14 mate together as shown in FIGS. 2 and 3 and the door 10 is in the closed configuration, the fin 64 deflects against the lower edge 18 of the superjacent panel 14 thereby providing a barrier or seal at the joint between the adjacent panels to inhibit and prevent the passage of water, rain, wind or other elements.

The combined weather seal, light block and wear insert 12 according to the embodiments shown in FIGS. 2 and 7–9 each also include a light blocking element in the form of an upwardly projecting fin 66 which blocks the transmission of light between the mating edges 16, 18 of adjacent panels 14. Preferably, the fin 66 is generally planar and projects generally perpendicularly from the wear insert portion proximate a terminal edge of the trailing tail 58 to which it is attached. Alternatively, the fin 66 may be of another configuration appropriate to satisfy its operational requirements. In the embodiment shown in FIGS. 2 and 7–9, the fin 66 is flexible and made from a thermoplastic elastomer (TPE) such as Santoprene® (www.santoprene.com) or equivalent material. The fin 66 has a thickness of approximately 0.025 inches and a height of approximately 0.100 inches. The fin 66 extends the entire width of the panel 14 and may be colored or tinted to inhibit the passage of light there through. The fin 66 extends generally perpendicularly in a planar orientation when the door 10 is not in a closed configuration; however, when the upper and lower edges 16, 18 of the panels 14 mate together as shown in FIGS. 2 and 3 and the door 10 is in the closed configuration, the fin 66 may deflect against the lower edge 18 of the superjacent panel 14 thereby providing a barrier or seal at the joint between the adjacent panels to inhibit and prevent the passage of light.

It should be readily appreciated that although certain embodiments and configurations of the invention are shown and described herein, the invention is not so limited. For example, while the combined weather seal, light block and wear insert 12 is shown anchored by legs 52 into the groove 56, other attachment mechanisms are readily available within the scope of this invention. Moreover, the combined weather seal, light block and wear insert 12 is shown in a specific configuration for compatibility with the panel design shown in FIGS. 2 and 3 while other configurations and designs of the invention are envisioned for implementation on panels of different configurations. Likewise, the combined weather seal, light block and wear insert 12 may be utilized or attached to the lower edge 18 of the superjacent panel 14 alone or in combination with attachment to the upper edge 16. Additionally, the configuration, position, placement and design of the fin 64 may be modified within the scope of this invention for compatibility with the configurations of the upper and lower edges 16, 18 of the panels 14 which may differ from those shown in FIGS. 2 and 3.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

We claim:

1. An overhead door capable of being selectively moved between a generally horizontal open configuration and a generally vertical closed configuration covering an opening, the door comprising:

a plurality of serially connected panels; and a plurality of hinges joining adjacent panels;

wherein selected ones of the panels further comprise:

a) an upper edge separated from a lower edge, the upper edge of each panel mating with the lower edge of an adjacent panel when the door is in the closed configuration, wherein the hinges are separated from the upper and lower edges of the adjacent panels;

b) at least one contact location between the upper and lower edges of adjacent panels when the door is in the closed configuration;

c) an insert on at least one of the upper and lower edges of the adjacent panels, the insert further comprising a wear portion interposed between the upper and lower edges of the adjacent panels at the contact location when the door is in the closed configuration and in contact with the adjacent panels when the adjacent panels are pivoting relative to each other and a seal portion projecting from the wear portion.

2. The overhead door of claim 1 wherein the wear portion of the insert substantially conforms to a section of the edge of the panel on which it is positioned and minimizes frictional interaction between the upper and lower edges of the adjacent panels during movement of the door to and between the open and closed configurations.

3. The overhead door of claim 1 wherein the insert extends substantially an entire width of the panels.

4. The overhead door of claim 1 wherein the insert covers less than the entire depth of the edge of the panel on which it is positioned.

5. The overhead door of claim 1 wherein the insert is mounted to the upper edge of each of the selected panels.

6. The overhead door of claim 5 wherein the selected ones of the panels further comprise:

a groove formed into the edge of the panel on which the insert is located.

7. The overhead door of claim 6 wherein each insert further comprises:

at least one leg positioned in the groove to thereby attach the insert to the associated panel.

8. An overhead door capable of being selectively moved between a generally horizontal open configuration and a generally vertical closed configuration covering an opening, the door comprising:

a plurality of serially connected panels; and a plurality of hinges joining adjacent panels;

wherein selected ones of the panels further comprise:

a) an upper edge separated from a lower edge, the upper edge of each panel mating with the lower edge of an adjacent panel when the door is in the closed configuration;

b) a pair of spaced contact locations between the upper and lower edges of the adjacent panels when the door is in the closed configuration, the contact locations being separated by a region in which the upper and lower edges are not in contact with each other;

c) an insert on at least one of the upper and lower edges of the adjacent panels, the insert further comprising a wear portion interposed between the upper and lower edges of the adjacent panels at the contact location when the door is in the closed configuration and in contact with the adjacent panels when the adjacent panels are pivoting relative to each other and a seal portion projecting from the wear portion.

9. The overhead door of claim 8 wherein the wear portion of the insert is interposed between only one of the contact locations when the door is in the closed configuration.

10. The overhead door of claim 8 wherein the wear portion of the insert is interposed between each of the pair of spaced contact locations.

11. The overhead door of claim 1 wherein the seal portion further comprises:

a first fin projecting from the wear portion of the insert.

12. The overhead door of claim 1 wherein the seal portion further comprises:

a first generally planar and flexible fin.

13. The overhead door of claim 1 wherein the seal portion is contacted by the adjacent panel when the door is in the closed configuration.

14. The overhead door of claim 1 wherein the seal portion and the wear portion are integrally molded together.

15. The overhead door of claim 11 wherein the seal portion further comprises:

a second fin projecting from the wear portion of the insert.

16. The overhead door of claim 15 wherein the first and second fins each project generally perpendicularly from the wear portion of the insert when the door is in the open configuration.

17. The overhead door of claim 15 wherein the first and second fins are spaced from one another and the second fin is proximate a terminal edge of the insert to inhibit light from passing between the adjacent panels.

18. An overhead door capable of being selectively moved between a generally horizontal open configuration and a generally vertical closed configuration covering an opening, the door comprising:

a plurality of serially connected panels; and a plurality of hinges joining adjacent panels;

wherein selected ones of the panels further comprise:

a) an upper edge separated from a lower edge, the upper edge of each panel mating with the lower edge of an adjacent panel when the door is in the closed configuration;

b) a pair of spaced contact locations between the upper and lower edges of adjacent panels when the door is in the closed configuration;

c) a groove formed into the upper edge of each of the selected panels;

d) an insert on the upper edge of each of the selected panels, wherein the insert extends substantially an entire width of the panels and covers less than the entire upper edge of the panel on which it is positioned, the insert further comprising:

(1) a wear portion interposed between the upper and lower edges of the adjacent panels at the contact locations when the door is in the closed configuration and in contact with the adjacent panels when the adjacent panels are pivoting relative to each other;

wherein the wear portion of the insert substantially conforms to a section of the edge of the panel on which it is positioned and minimizes frictional interaction between the upper and lower edges of the adjacent panels during movement of the door to and between the open and closed configurations;

(2) a weather seal portion projecting from the wear portion and being deflected by the adjacent panel when the door is in the closed configuration;

(3) a light blocking portion projecting from the wear portion, spaced from the weather seal portion and being deflected by the adjacent panel when the door is in the closed configuration;

wherein the weather seal portion and the light blocking portion further comprises a pair of generally planar and flexible fins projecting generally perpendicularly from the wear portion of the insert when the door is in the open configuration; and (4) at least one leg positioned in the groove to thereby releasably attach the insert to the associated panel.

19. The overhead door of claim 1 wherein the seal portion projects generally perpendicularly from the wear portion.

20. An overhead door capable of being selectively moved between a generally horizontal open configuration and a generally vertical closed configuration covering an opening, the door comprising:

a plurality of serially connected panels; and a plurality of hinges joining adjacent panels;

wherein selected ones of the panels further comprise:

a) an upper edge separated from a lower edge, the upper edge of each panel mating with the lower edge of an adjacent panel when the door is in the closed configuration and the upper and lower edges of the adjacent panels substantially separating from one another when the door is moving between the closed and open configurations;

b) at least one contact location between the upper and lower edges of adjacent panels when the door is in the closed configuration;

c) an insert on at least one of the upper and lower edges of the adjacent panels, the insert further comprising a wear portion interposed between the upper and lower edges of the adjacent panels at the contact location when the door is in the closed configuration and in contact with the adjacent panels when the adjacent panels are pivoting relative to each other and a seal portion projecting from the wear portion.

21. The overhead door of claim 20 wherein the wear portion of the insert substantially conforms to a section of the edge of the panel on which it is positioned and minimizes frictional interaction between the upper and lower edges of the adjacent panels during movement of the door to and between the open and closed configurations.

22. The overhead door of claim 20 wherein the insert extends substantially an entire width of the panels.

23. The overhead door of claim 20 wherein the insert covers less than the entire depth of the edge of the panel on which it is positioned.

24. The overhead door of claim 20 wherein the insert is mounted to the upper edge of each of the selected panels.

25. The overhead door of claim 20 wherein the selected ones of the panels further comprise:

a groove formed into the edge of the panel on which the insert is located.

26. The overhead door of claim 25 wherein each insert further comprises:

at least one leg positioned in the groove to thereby attach the insert to the associated panel.

27. The overhead door of claim 20 further comprising:

a pair of spaced contact locations between the upper and lower edges of the adjacent panels when the door is in the closed configuration, the contact locations being separated by a region in which the upper and lower edges are not in contact with each other.

28. The overhead door of claim 27 wherein the wear portion of the insert is interposed between only one of the contact locations when the door is in the closed configuration.

29. The overhead door of claim 27 wherein the wear portion of the insert is interposed between each of the pair of spaced contact locations.

30. The overhead door of claim 20 wherein the seal portion further comprises:

a first fin projecting from the wear portion of the insert.

31. The overhead door of claim 20 wherein the seal portion further comprises:

a first generally planar and flexible fin.

32. The overhead door of claim 20 wherein the seal portion is contacted by the adjacent panel when the door is in the closed configuration.

33. The overhead door of claim 20 wherein the seal portion and the wear portion are integrally molded together.

34. The overhead door of claim 30 wherein the seal portion further comprises:

a second fin projecting from the wear portion of the insert.

35. The overhead door of claim 34 wherein the first and second fins each project generally perpendicularly from the wear portion of the insert when the door is in the open configuration.

36. The overhead door of claim 34 wherein the first and second fins are spaced from one another and the second fin is proximate a terminal edge of the insert to inhibit light from passing between the adjacent panels.

* * * * *